US006302269B1

(12) United States Patent
Risch

(10) Patent No.: US 6,302,269 B1
(45) Date of Patent: Oct. 16, 2001

(54) BRUSH IMPLEMENT

(76) Inventor: Richard S. Risch, 15206 Ceres Ave., Fontana, CA (US) 92335

( * ) Notice: Subject to any disclaimer, the term of this patent is extended or adjusted under 35 U.S.C. 154(b) by 0 days.

(21) Appl. No.: 09/371,971

(22) Filed: Aug. 10, 1999

(51) Int. Cl.[7] ..... A47L 23/00; B65D 85/00
(52) U.S. Cl. ..... 206/362.3; 206/466; 15/187
(58) Field of Search ..... 15/187, 188; 206/362.3, 206/362.2, 466

(56) References Cited

U.S. PATENT DOCUMENTS

| | | | | |
|---|---|---|---|---|
| 2,075,413 | * | 3/1937 | Welker | 15/188 |
| 2,958,889 | * | 11/1960 | Greenblatt | 15/187 |
| 3,747,150 | | 7/1973 | Kozub . | |
| 4,571,767 | | 2/1986 | Dangler . | |
| 4,785,490 | | 11/1988 | Thomas . | |
| 4,945,596 | | 8/1990 | Chang et al. . | |
| 5,060,337 | * | 10/1991 | Van Niekerk | 15/188 |
| 5,077,858 | | 1/1992 | Lewis, Jr. . | |
| 5,230,117 | | 7/1993 | Johnson et al. . | |
| 5,551,111 | | 9/1996 | Murphy . | |
| 5,555,589 | | 9/1996 | Moultrie . | |
| 5,761,833 | | 6/1998 | McMullin . | |

* cited by examiner

*Primary Examiner*—Randall E. Chin
(74) *Attorney, Agent, or Firm*—Blakely, Sokoloff, Taylor & Zafman LLP

(57) ABSTRACT

The invention relates to a brush implement for cleaning the soft spikes of a golf shoe. The brush implement has a head onto which a plurality of thermoplastic nubs are fastened, wherein the nubs are made of a thermoplastic material. An extension may be attached to the handle that is designed to be held or operated with the hand. Other features are disclosed.

22 Claims, 2 Drawing Sheets

BRUSH IMPLEMENT

BACKGROUND OF THE INVENTION

1. Field of the Invention

The present invention relates generally to brush implements.

2. Prior Art

The preferred embodiment of the present invention is intended for cleaning the short, plastic densely spaced spikes of golf shoe cleats. Accordingly only the prior art relating thereto is discussed in detail herein.

Golf is a game played on a large outdoor golf course with a series of nine or eighteen holes spaced far apart, the object being to propel a small, hard, golf ball with the use of various clubs into each hole with as few strokes as possible. A golf course is comprised of fairways made of short grass, putting greens made of cropped, manicured grass, sand traps, water traps, and areas known as the rough where the golf course is left unmowed and uncultivated to create a rugged, overgrown terrain.

A golfer moves the golf ball about the golf course by planting the golfer's feet firmly into the course and, after rotating his or her upper torso and arms, swinging to strike the golf ball. To provide traction for the golfer during the swing irrespective of the position on the golf course that the golf ball has come to a stop, golf shoes conventionally have projecting pieces of metal attached to the underside of the shoe. These spikes extend from cleats attached to the sole of the shoe so as to implant into the surface layer of the terrain of the golf course. These metal spikes damage the golf course turf and thus present a constant problem in maintaining the grass of the course, particularly on the putting greens.

To counter these green-unfriendly metal spikes, a metal spike alternative movement formed in the golf industry. Golf course operators and others have sought to ban the use of metal spikes and to require the use of soft spikes on the bottom of golf shoes. For example, to promote its U.S. Pat. No. 5,761,833 on soft spiked golf shoes, Softspikes®, Inc. of Rockville, Md. has spearheaded the effort to ban metal spikes at golf courses nationwide. Today, more than 5,000 golf courses, including eighty of Golf Digest's Top One Hundred Courses, have banned metal spikes as a result of Softspikes®' pioneering work.

Soft spikes are made of various types of thermoplastics or hard rubbers. To provide a gentler gripping action, soft spikes are shorter in length than conventional metal spikes but compensate for this short length by increasing the number of soft spikes per cleat. Due to the greater density of the short soft spikes, the non-metallic spikes may become plugged with imbedded grass and dirt. This imbedded grass and dirt minimizes traction and causes the golfer to lose footing. Thus, there is a need for a brush implement for cleaning the short, plastic, densely spaced spikes of a golf shoe in a convenient, quick manner.

BRIEF SUMMARY OF THE INVENTION

This invention relates to a brush implement which, in a preferred form, provides a brush for cleaning the soft spikes of a golf shoe. The brush implement is a unitary structure of thermoplastic material having a head on which a plurality of thermoplastic nubs are integrally formed. The brush implement includes an integral handle which may be curved back onto itself to form a handle that is designed to be held or operated with the hand. Other embodiments and features are disclosed.

DETAILED DESCRIPTION OF THE PREFERRED EMBODIMENT

For purposes of explanation, specific embodiments are set forth to provide a thorough understanding of the present invention. However, it will be understood by one skilled in the art, from reading this disclosure, that the invention may be practiced without these details. Moreover, well-known elements, devices, process steps and the like are not set forth in detail in order to avoid obscuring the present invention.

Figure 1:
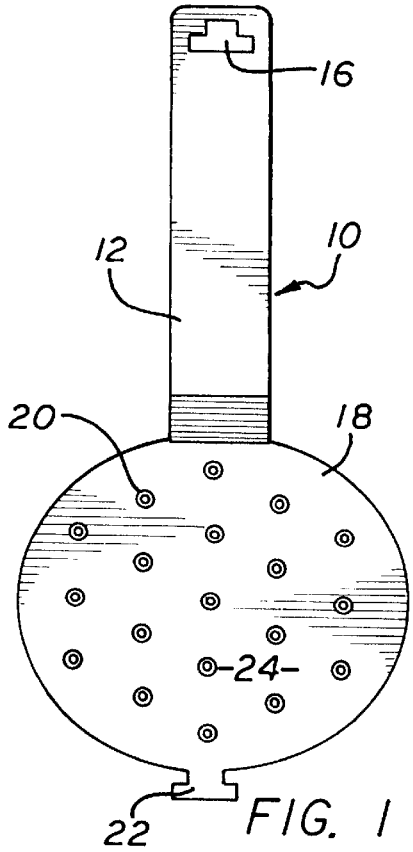
FIG. 1 is a plan rear view of an embodiment of a brush of the invention.

Reference is now made to FIGS. 1 through 9 to illustrate an embodiment of the invention. FIG. 1 is a plan rear view of an embodiment of brush 10 illustrating the various unitary components of the brush, including head 18 and strap 12. Elongated and thin (preferably approximately ⅛ inch thick), strap 12 of FIG. 1 has a keyhole shaped opening 16 at one end, and is integrally coupled to head 18 at the other end. Head 18 may be in the shape of an oval, square, diamond, or any other shape as the shape is predominately a function of aesthetic choice as suited to a particular application. As an oval shape, preferably head 18 has one axis measuring approximately 2½ inches and the other axis measuring approximately 3 inches.

Head 18 provides a backing structure on which nubs 20 are disposed. Nubs 20 may be used to clean the soft spikes of athletic shoes free of mud, grass, soil, and debris. Preferably, for use as a golf shoe cleaner, there are nineteen nubs 20 displaced symmetrically about the longitudinal axis of the head 18 of brush 10. With one axis measuring 2½ inches and the other axis measuring three inches, this gives a nub density of approximately 3.8 nubs per square inch of head 18. However, nub densities ranging from two nubs per square inch to ten nubs per square inch are preferred for use as a golf shoe cleaning brush, with as many as approximately forty nine nubs per square inch being useful for other purposes, such as for a hair brush. Also attached to head 18 is key 22. As a T-shaped protrusion extending away from head 18 in the opposite direction of strap 12, key 22 may serve to lock strap 12 to head 18 as discussed in connection with FIGS. 7 and 8.

Figure 2:
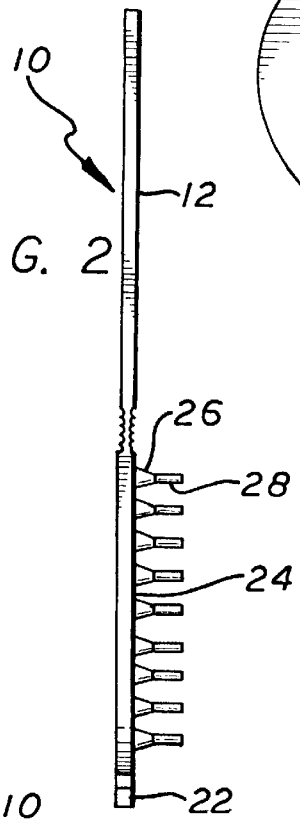
FIG. 2 is a side view of a brush that reveals a profile of each nub.

FIG. 2 is a side view of brush 10 showing the typical profile of each nub 20. Nubs 20 preferably taper inward as cone 26 from surface 24 of head 18 to provide rigidity near surface 24, and flexibility as cone 26 extends away from cone shape 26 into cylindrical protrusions 28. The rigidity aids in extending the life time of brush 10 and the flexibility aids in removing mud, grass, soil, and debris from the soft spikes without damaging the soft spikes. Preferably, the brush and thus the nubs 20 are injection molded of a selected thermoplastic material to provide sufficient rigidity and abrasion resistance for convenient holding and use, while at the same time preventing damage to the soft spikes through the use of brush 10. Brush 10 may also be made of a thermoplastic material.

Figure 3:
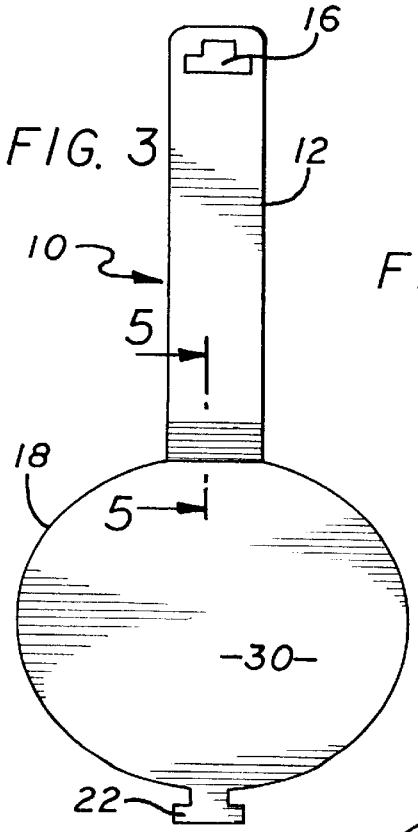
FIG. 3 is a plan front view of a brush of the invention.
Figure 4:
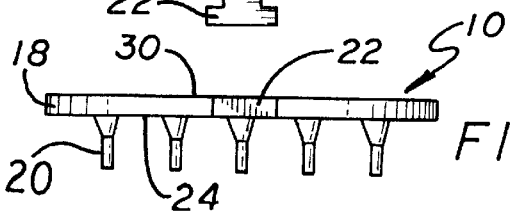
FIG. 4 is a first end view of a brush of the invention.

FIG. 3 is a plan front view of brush, 10 and FIG. 4 is a front profile view of brush 10. As can be seen in FIGS. 2 and 3, top surface 30 of head 18 is a smooth and flat surface. FIG. 4 shows that key 22, like strap 12 of FIG. 1, preferably lies within the thickness of head 18. Thus in general, except for the nubs and a region of increases flexibility of the strap, the brush is of uniform material thickness in accordance with good injection molding practice.

Figure 5:
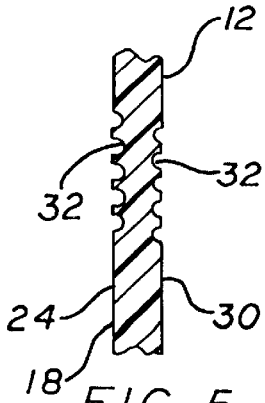
FIG. 5 is a sectional view taken along line 5—5 of FIG. 3.

FIG. 5 is a sectional view taken along line 5—5 of FIG. 3, illustrating grooves 32 formed in the surfaces of strap 12 along the bottom 24 and top 30 surfaces thereof. Preferably, five grooves 32 on bottom 24 are offset from five grooves 32 on top 30 by approximately the radius of each groove 32. The grooves form a region of increased flexibility of the strap, the function of which will be subsequently described.

Figure 6:
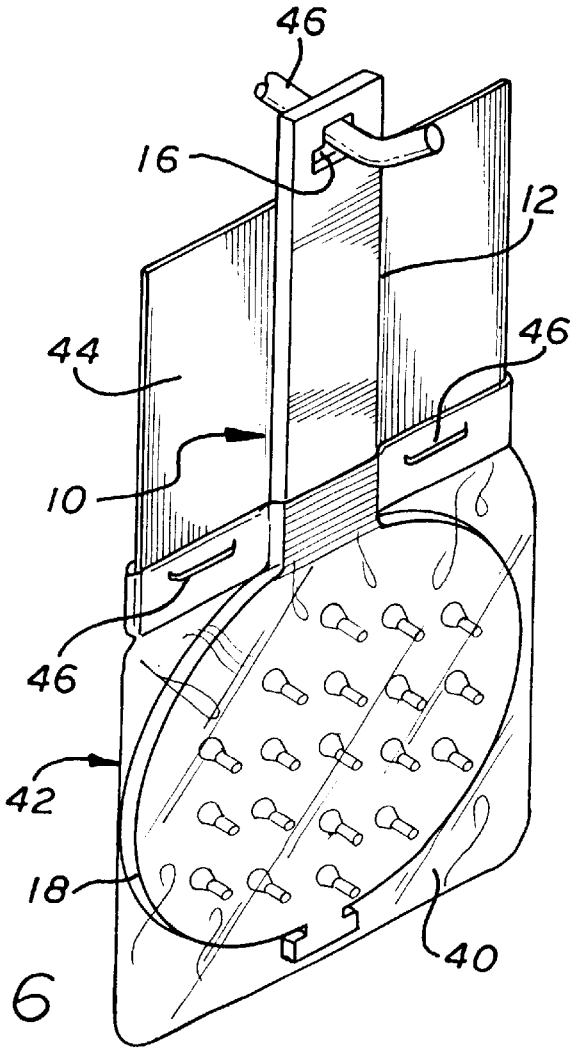
FIG. 6 is a perspective view of a brush of the invention as it may be hung for sale display.

FIG. 6 is a perspective view of brush 10 as it may be displayed for sale. Polyethylene bag 40 forms a container 42 serving as a receptacle to enclose head 18. To provide a location on which to place printed information, cardboard backing 44 may be attached to bag 42 by two staples 46. To display brush 10 for sale, the product may be hung on a display hook 46 by key hole 16.

Figure 7:
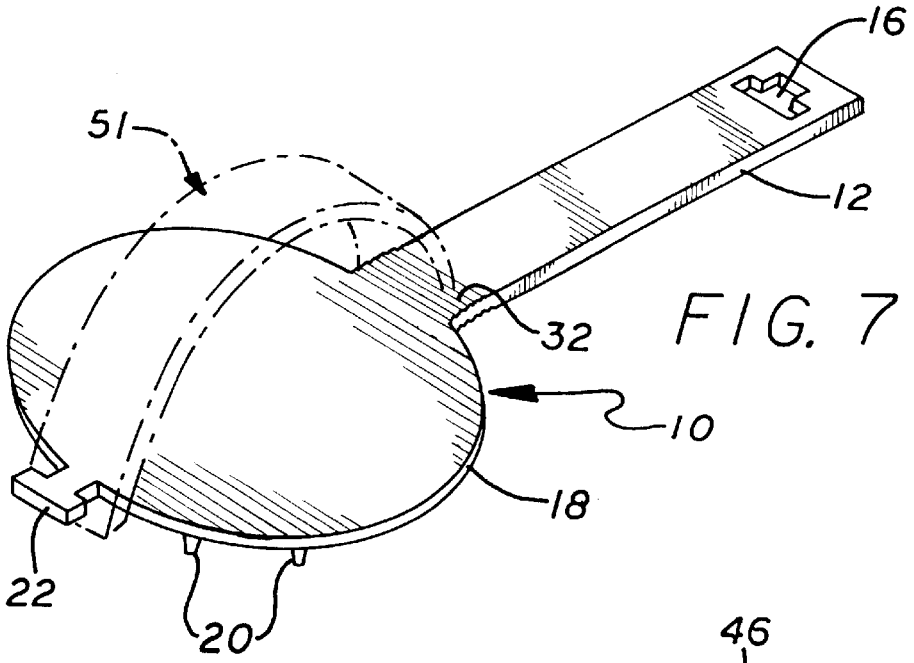
FIG. 7 shows an extension of the brush bent into a holding strap.
Figure 8:
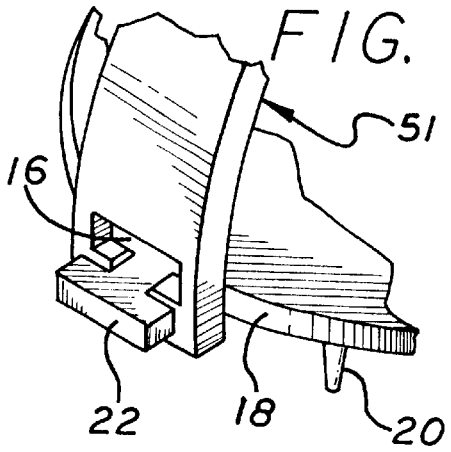
FIG. 8 is a detailed view of the key of the brush inserted into the keyhole opening of the brush.

In one embodiment, strap 12 is used to hold brush 10 to the hand of the user. In particular, FIG. 7 shows strap 12 being bent into the finger encircling member 51 of FIGS. 7, 8 and 9. After removing any packaging from brush 10, the user bends the strap, and inserts key 22 into key hole 16 as shown in FIG. 8 to lock strap 12 to key 22 on head 18. In general the elasticity of the material will hold the key in the keyhole, though a press fit may be used if desired.

Figure 9:
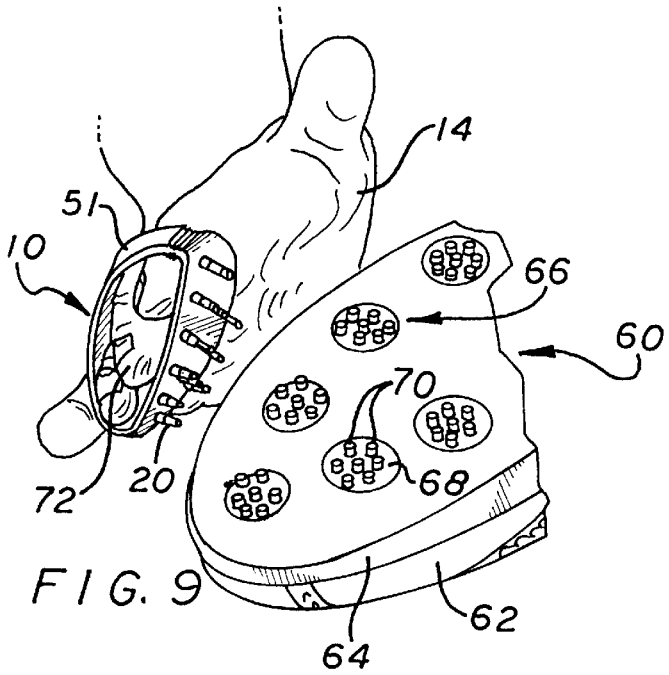
FIG. 9 shows one embodiment of the application of the brush to soft spikes.

FIG. 9 shows the application of one embodiment of the brush to the cleaning of soft spikes on athletic shoes. Athletic shoe 60 comprises cover 62 onto which is sewn hard sole 64. Coupled to the bottom of sole 64 are cleats 66. Each cleat 66 is formed from base 68 onto which are molded a plurality of soft spikes 70 projecting away from sole 64. These soft spikes 70 are made of a non-metallic material such as plastic, an example of which may be seen in U.S. Pat. No. 5,761,833. Soft spikes 70 may be attached to the soles of golf shoes or any other athletic shoe where it is necessary to obtain traction on a fragile surface.

As seen in FIG. 9, brush 10 will have nubs 20 that extend away from brush 10, and strap 51 encircling fingers 72 of hand 14. Nubs 20 may be used to clean soft spikes 70 free of mud, grass, soil and other debris. To prevent damage to soft spikes 70, nubs 20 of brush 10 are made preferably of a material similar to the soft spikes 70 themselves.

While the present invention has been particularly described with reference to the various Figures, it should be understood that the Figures and detailed description, and the identification of certain preferred and alternate materials, are for illustration only and should not be taken as limiting the scope of the invention or excluding still other alternatives. Many changes and modifications may be made to the invention, by one having ordinary skill in the art, without departing from the matter and scope of the invention.

What is claimed is:

1. A brush implement, comprising:

a unitary injection molded member having a head with a plurality of nubs projecting from a first surface thereof, and a handle coupled to one edge of the head, the head and the handle being substantially flat and having approximately the same thickness, the handle being an elongated strap having a near end coupled to the head and a distal end, the distal end of the handle and the head opposite the handle having complementary members for engaging each other to retain the distal end of the handle to the head in a region opposite the near end of the handle to form a finger encircling member over the head.

2. The brush implement of claim 1, wherein the head comprises an elliptical shape and the plurality of nubs have a density of less than fifty nubs per square inch of head.

3. The brush implement of claim 2, the elliptical shape having a first diameter and a second diameter, wherein the first diameter is 2½ inches and the second diameter is 3 inches.

4. A brush implement, comprising:

a unitary injection molded member having an elliptical shaped head with a plurality of nubs having a density of less than fifty nubs per square inch of head projecting from a first surface thereof, and a handle coupled to one edge of the head, the handle being an elongated strap having a near end coupled to the head and a distal end, the distal end of the handle and the head opposite the handle having complementary members for engaging each other to retain the distal end of the handle to the head in a region opposite the near end of the handle to form a finger encircling member over the head, the head and the handle being substantially flat and having approximately the same thickness.

5. The brush implement of claim 4, the elongated strap having a top side, a bottom side, and a thickness, wherein the region of increased flexibility is defined by a plurality of grooves formed in the thickness of the strap along the top side and bottom side, the plurality of grooves extending across the near end of the elongated strap with the grooves on the top side alternating in location with respect to the grooves on the bottom side.

6. A brush implement, comprising:

a unitary injection molded member having a elliptical shaped head with a plurality of nubs projecting from a first surface thereof, and a handle coupled to one edge of the head, the head having a density of less than fifty nubs per square inch of head, the head and the handle being substantially flat and having approximately the same thickness, each nub of the plurality of nubs having a first portion and a second portion, wherein the first portion is coupled to the head and tapers conically inward and wherein the second portion is coupled to the first portion and is cylindrical.

7. The brush implement of claim 6, the head having a longitudinal axis, wherein there are nineteen nubs displaced symmetrically about the longitudinal axis of the head at a density of approximately 3.8 nubs per square inch of head.

8. A brush implement for cleaning the soft spikes of an athletic shoe, the brush implement comprising:

a unitary injection molded member having a head with a plurality of nubs projecting from a first surface thereof, and a handle coupled to one edge of the head, the head and the handle being substantially flat and having approximately the same thickness, the nubs having a density of less than ten nubs per square inch of head, the handle being an elongated strap having a near end coupled to the head and a distal end, the distal end of the handle and the head opposite the handle having complementary members for engaging each other to retain the distal end of the handle to the head in a region opposite the near end of the handle to form a finger encircling member over the head.

9. The brush implement of claim 8, the elongated strap having a top side, a bottom side, and a thickness, wherein the region of increased flexibility is defined by a plurality of grooves formed in the thickness of the strap along the top side and bottom side, the plurality of grooves extending across the near end of the elongated strap with the grooves on the top side alternating in location with respect to the grooves on the bottom side.

10. A brush implement for cleaning the soft spikes of an athletic shoe, the brush implement comprising:

a unitary injection molded member having a head with a plurality of nubs projecting from a first surface thereof, and a handle coupled to one edge of the head, the head and the handle being substantially flat and having approximately the same thickness, the nubs having a density of less than ten nubs per square inch of head, each nub of the plurality of nubs having a first portion and a second portion, wherein the first portion is coupled to the head and tapers conically inward and wherein the second portion is coupled to the first portion and is cylindrical.

11. The brush implement of claim 10, the head having a longitudinal axis, wherein there are nineteen nubs displaced symmetrically about the longitudinal axis of the head at a density of approximately 3.8 nubs per square inch of head.

12. The brush implement of claim 11, the head having an elliptical shape.

13. The brush implement of claim 12, the elliptical shape having a first diameter and a second diameter, wherein the first diameter is 2½ inches and the second diameter is 3 inches.

14. A packaged brush implement for cleaning the soft spikes of an athletic shoe, comprising:

a unitary injection molded member having a head with a plurality of nubs projecting from a first surface thereof, and a handle coupled to one edge of the head, the head and the handle being substantially flat and having approximately the same thickness, the nubs having a density of less than ten nubs per square inch of head, a clear plastic bag enclosing the head of the brush implement, and a display card being stapled to the plastic bag and extending parallel to the handle.

15. The packaged brush implement of claim 14, the head having an elliptical shape.

16. The packaged brush implement of claim 15, the elliptical shape having a first diameter and a second diameter, wherein the first diameter is 2½ inches and the second diameter is 3 inches.

17. The packaged brush implement of claim 15, the handle being an elongated strap having a near end coupled to the head and a distal end, the distal end of the handle and the head opposite the handle having complementary members for engaging each other to retain the distal end of the handle to the head in a region opposite the near end of the handle to form a finger encircling member over the head.

18. The packaged brush implement of claim 17, the elongated strap having a top side, a bottom side, and a thickness, wherein the region of increased flexibility is defined by a plurality of grooves formed in the thickness of the strap along the top side and bottom side, the plurality of grooves extending across the near end of the elongated strap with the grooves on the top side alternating in location with respect to the grooves on the bottom side.

19. The packaged brush implement of claim 15, each nub of the plurality of nubs having a first portion and a second portion, wherein the first portion is coupled to the head and tapers conically inward and wherein the second portion is coupled to the first portion and is cylindrical.

20. The packaged brush implement of claim 19, the head having a longitudinal axis, wherein there are nineteen nubs displaced symmetrically about the longitudinal axis of the head at a density of approximately 3.8 nubs per square inch of head.

21. A brush implement, comprising:

a unitary injection molded member having a head with a plurality of nubs projecting from a first surface thereof, and a handle coupled to one edge of the head, the head having a density of less than fifty nubs per square inch of head, the head and the handle being substantially flat and having approximately the same thickness, each nub of the plurality of nubs having a first portion and a second portion, wherein the first portion is coupled to the head and tapers conically inward and wherein the second portion is coupled to the first portion and is cylindrical.

22. The brush implement of claim 21, the head having approximately 3.8 nubs per square inch of head.

* * * * *